US006217364B1

(12) United States Patent
Miskin et al.

(10) Patent No.: US 6,217,364 B1
(45) Date of Patent: Apr. 17, 2001

(54) ELECTRICAL CONNECTOR ASSEMBLY WITH GUIDE PIN LATCHING SYSTEM

(75) Inventors: Michael Miskin, Little Rock, AR (US); Michael F. Magajne, Cicero, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/350,237

(22) Filed: Jul. 9, 1999

(51) Int. Cl.[7] ..... H01R 13/627
(52) U.S. Cl. ..... 439/358; 439/953
(58) Field of Search ..... 439/358, 357, 439/953

(56) References Cited

U.S. PATENT DOCUMENTS

| | | | | |
|---|---|---|---|---|
| 4,980,800 | * | 12/1990 | Furuta | 361/391 |
| 5,154,629 | * | 10/1992 | Carver et al. | 439/358 |
| 5,167,523 | * | 12/1992 | Crimmins et al. | 438/358 |
| 5,190,472 | | 3/1993 | Voltz et al. | 439/579 |
| 5,194,020 | | 3/1993 | Voltz | 439/579 |
| 5,368,505 | | 11/1994 | Hoolhorst et al. | 439/701 |
| 5,380,216 | | 1/1995 | Broeksteeg et al. | 439/352 |
| 5,417,590 | | 5/1995 | Dechelette et al. | 439/607 |
| 5,772,475 | | 6/1998 | Lindeberg et al. | 439/701 |
| 5,779,495 | | 7/1998 | Dechelette et al. | 439/353 |
| 5,823,812 | * | 10/1998 | Bhargava et al. | 439/345 |

* cited by examiner

*Primary Examiner*—Tulsidas Patel
*Assistant Examiner*—Javaid Nasri
(74) *Attorney, Agent, or Firm*—Robert A. Yesukevich

(57) ABSTRACT

An electrical connector assembly includes a first connector having a guide hole in a mating face thereof. A second connector includes a guide pin for insertion into the guide hole of the first connector, the guide pin having a latch portion. A latch member on the first connector engages the latch portion of the guide pin of the second connector when the connectors are mated to hold the connectors in mated condition. Therefore, the guide pin performs a dual function of guiding the connectors as well as latching the connectors.

14 Claims, 4 Drawing Sheets

ELECTRICAL CONNECTOR ASSEMBLY WITH GUIDE PIN LATCHING SYSTEM

FIELD OF THE INVENTION

This invention generally relates to the art of electrical connectors and, particularly, to an electrical connector assembly which includes guide pins that perform a dual function of guiding a pair of connectors into mated condition as well as latching the connectors in the mated condition.

BACKGROUND OF THE INVENTION

A typical electrical connector assembly includes a pair of electrical connectors which interconnect respective conductive terminals when the connectors are mated. In some assemblies, extraneous latching mechanisms are provided to hold the connectors in mated condition and to prevent the connectors from pulling apart. Obviously, such latching mechanisms require space or occupy an area of the connectors. In some instances, this space can be considerable in relation to much smaller terminals of the connectors. If one connector is mounted on a circuit board, a panel or the like, the space required for the latching mechanisms can occupy valuable "real estate" on the board or panel.

Other connectors require some form of guiding mechanisms to guide the pair of connectors into mated condition and, thereby, ensure that the terminals are properly aligned and interconnected. For instance, one connector of a connector assembly may include one or more guide holes for receiving complementary guide pins projecting from the mating connector. Here again, such guiding mechanisms require space or occupy a considerable area of the connectors.

The present invention is directed to solving the problems of latching mechanisms and guiding mechanisms taking up excessive space by a unique system wherein one of the connectors of the connector assembly includes at least one guide pin that performs a dual function of not only guiding the connectors into mated condition but to facilitate latching the connectors in the mated condition.

SUMMARY OF THE INVENTION

An object, therefore, of the invention is to provide a new and improved electrical connector assembly of the character described which includes a unique guiding and latching system.

In the exemplary embodiment of the invention, the electrical connector assembly includes a first connector having a housing mounting a plurality of terminals. The housing has a guide hole at a mating face thereof. A second connector includes a housing mounting a plurality of terminals for connection to the terminals of the first connector when the connectors are mated. A guide pin on the second connector is insertable into the guide hole of the first connector to guide the connectors into mated condition. The guide pin has a latch portion. A latch member on the first connector is engageable with the latch portion of the guide pin when the connectors are mated to hold the connectors in mated condition. Therefore, the guide pin performs a dual function of guiding the connectors as well as latching the connectors.

As disclosed herein, a pair of the guide holes are provide at opposite ends of the mating face of the first connector, along with a pair of guide pins on the second connector. Both guide pins have latch portions, and the second connector includes a pair of the latch members. The latch portions on the guide pins are provided by notches in the sides thereof. The latch members include latch hooks engageable in the notches.

Each latch member comprises a latch arm pivotable relative to the housing of the first connector. In the preferred embodiment, the latch arm is a separate member independent of the housing of the first connector. The latch arm is pivoted to the housing intermediate opposite ends of the latch arm. One end of the latch arm is located inside the housing for engaging the latch notch of a respective one of the guide pins. An opposite end of the latch arm is located outside the housing for manual manipulation by an operator. The latch arms are fabricated of spring metal material, and the opposite ends of the latch arms include spring portions for biasing the hooked ends of the latch arms into latching condition with the notches of the guide pins.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
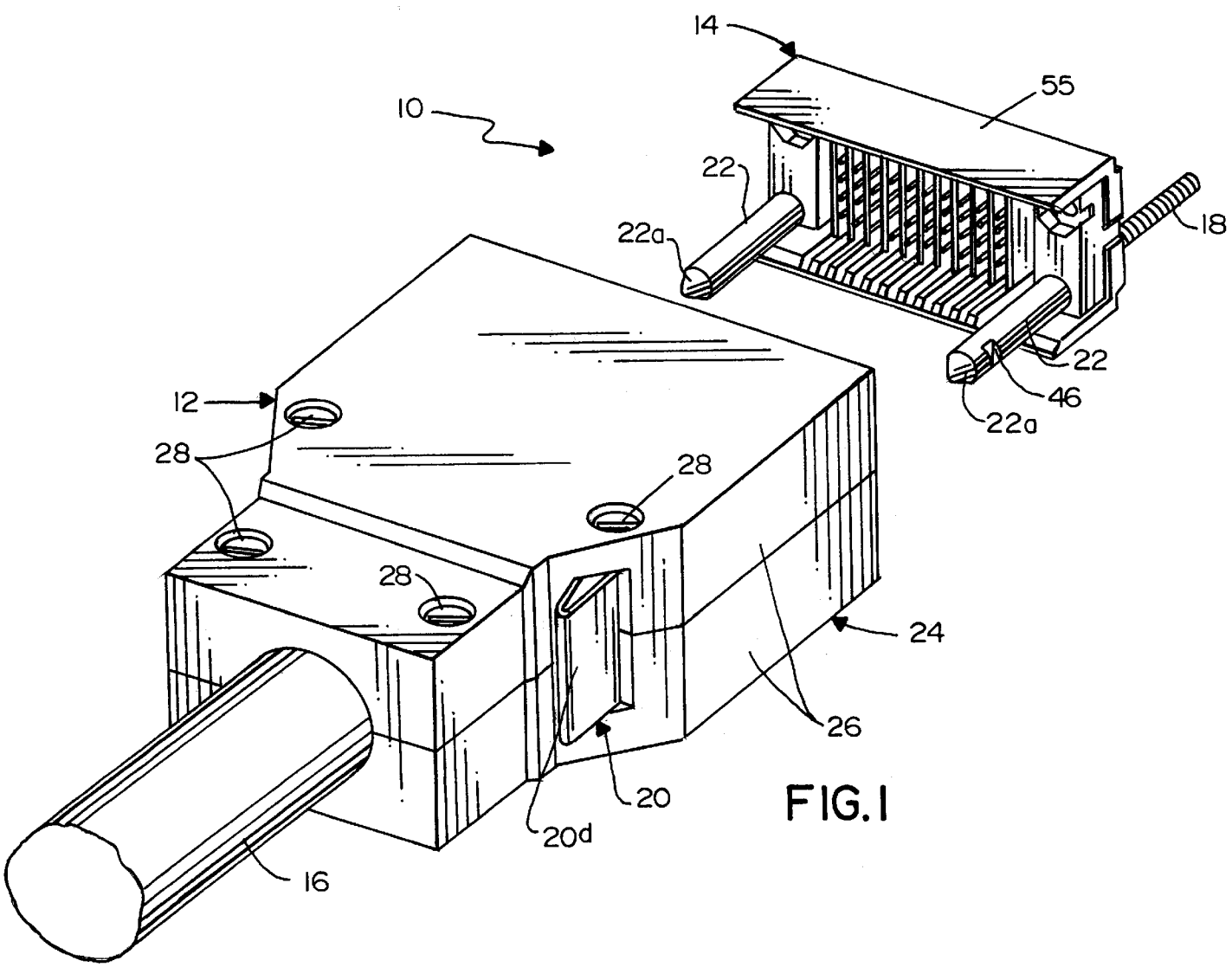
FIG. 1 is a perspective view of a pair of connectors of the electrical connector assembly embodying the concepts of the invention.

Referring to the drawings in greater detail, and first to FIG. 1, the invention is embodied in an electrical connector assembly, generally designated 10, which includes a first or cable connector, generally designated 12, and a second or header connector, generally designated 14. Cable connector 12 is provide for terminating a plurality of pairs of electrical wires of a high speed electrical cable 16. Header connector 14 includes a pair of externally threaded mounting posts 18 for mounting the header connector on a backplane, panel or the like. As will seen in greater detail hereinafter, cable connector 12 mounts a pair of latch members 20 on opposite sides thereof which are operatively associated with a pair of guide pins 22 at opposite ends of header connector 14.

Figure 2:
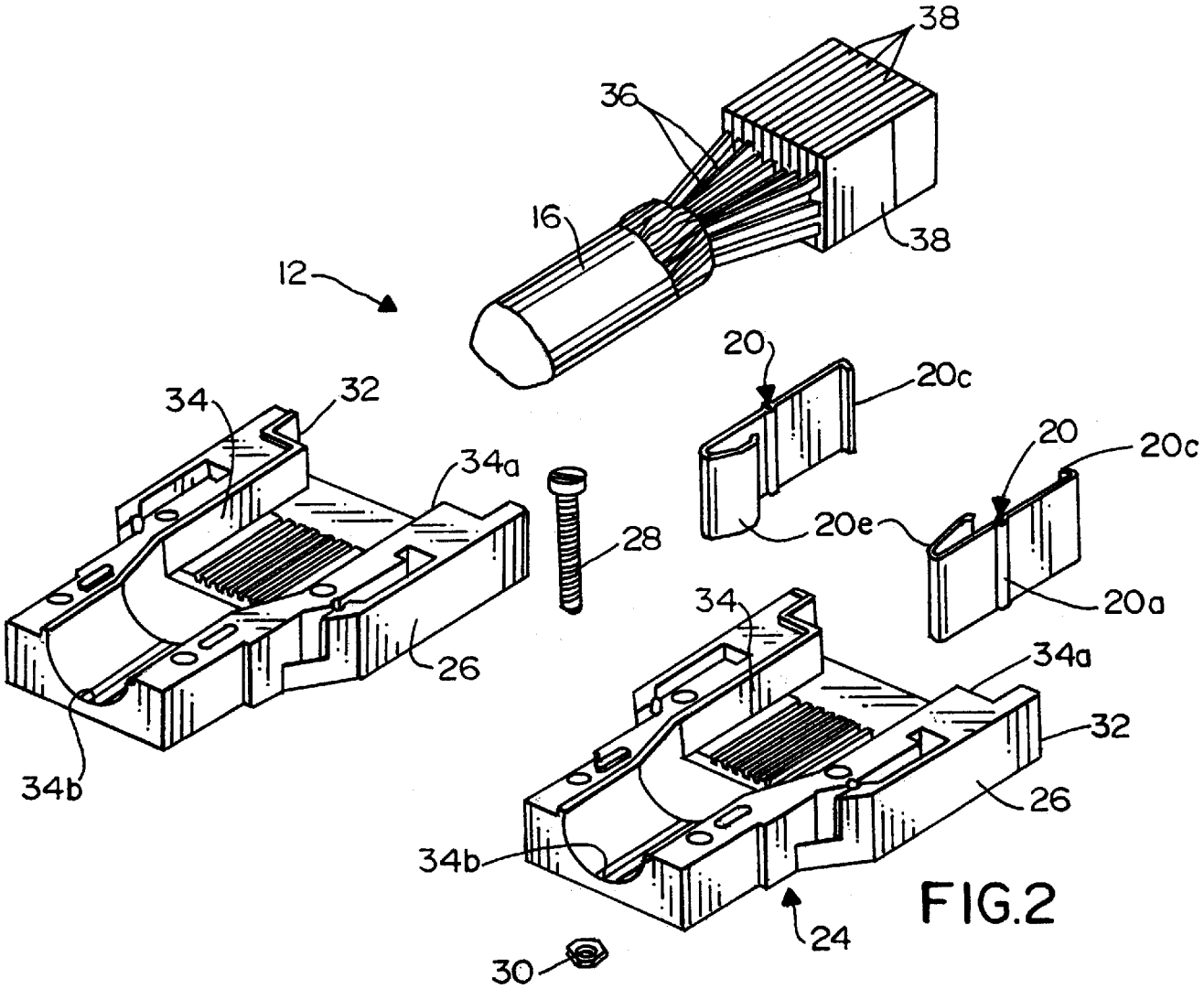
FIG. 2 is an exploded perspective view of one of the connectors.
Figure 3:
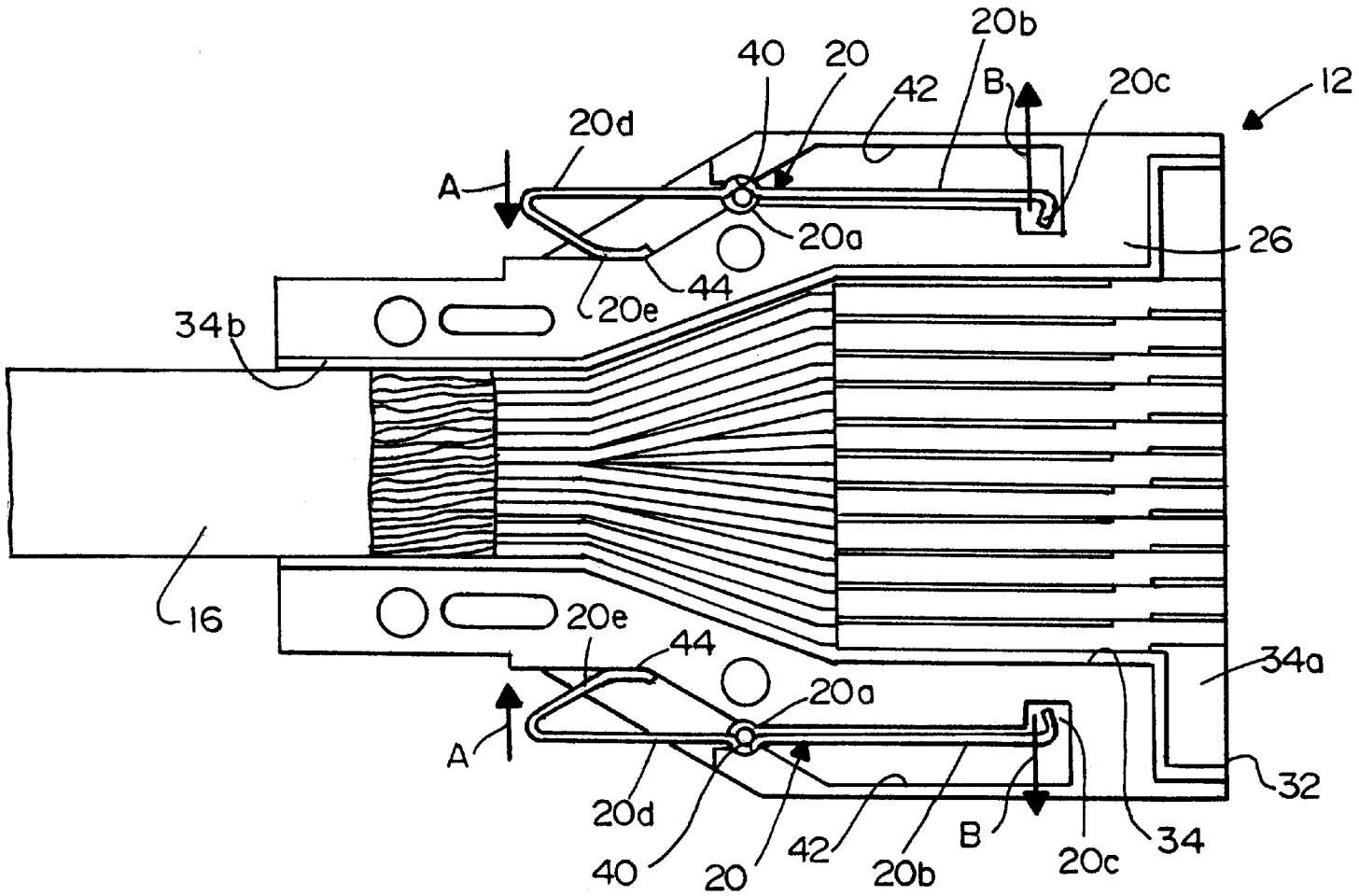
FIG. 3 is a view of the connector of FIG. 2, in assembled condition but with the top half of the housing removed.

Referring to FIGS. 2 and 3 in conjunction with FIG. 1, cable connector 12 includes a housing, generally designated 24, formed by a pair of substantially identical housing halves 26 held together by a plurality of bolts 28 and nuts 30. The housing defines a mating face 32. The housing halves combines to define an interior cavity 34 having a front opening 34*a* and a rear opening 34*b*. The housing halves may be fabricated of die-cast metal material or of molded plastic material. A boot (not shown) of elastomeric material may cover the housing. The boot may have access openings to the latch members.

Still referring to FIGS. 2 and 3, electrical cable 16 includes a plurality of twisted pairs of electrical wires 36 which are terminated to conductive terminals overmolded in a plurality of thin flat wafers 38. The wafers are molded of dielectric material such as plastic or the like. The wafers are closely juxtaposed in a parallel array and are positioned within interior cavity 34 of one of the housing halves 26 such that cable 16 projects out of rear opening 34*b* of the cavity as seen in FIG. 3. For instance, the cable and wafer subassembly can be positioned in a bottom one of the housing halves 26 (e.g., the right-hand housing half as viewed in FIG. 2) and the other housing half then is positioned on top of the one housing half to completely enclose the cable/wafer subassembly, with bolts 28 and nuts 30 being used to close housing 24 about the cable/wafer subassembly. As will be seen in describing FIG. 4, each plastic wafer 38 is overmolded about a plurality of female terminals which are exposed at front opening 34*a* of cavity 34 of housing 24.

As best seen in FIG. 3, cable connector 12 mounts a pair of the latch members 20 which were briefly mentioned in describing FIG. 1. Each latch member is formed by a latch arm stamped and formed of spring sheet metal material. Each latch arm is pivoted to housing halves 26 by a rounded pivot portion 20*a* formed intermediate opposite ends of the latch arm and disposed within rounded pivot cavities 40 in the housing halves. One end 20*b* of each latch arm is located within a cavity 42 of the housing halves and includes an inwardly directed latch hook 20*c*. An opposite end 20*d* of each latch arm is exposed exteriorly of the housing for manual engagement by an operator. This can be seen clearly in FIG. 1. The outside or opposite end of each latch arm is bent back inwardly to form a spring portion 20*e* which is engageable with the housing halves, as at 44. Therefore, when an operator moves outside ends 20*d* of the latch arms inwardly, as by a finger pinching action in the direction of arrows "A", inside latch hooks 20*c* of the latch arms will be moved or pivoted outwardly in the direction of arrows "B" about pivot portions 20*a* of the latch arms. When the latch arms are released, spring portions 20*e* of the latch arms will bias the latch arms back to the positions shown in FIG. 3, with latch hooks 20*c* in their latching positions.

Figure 4:
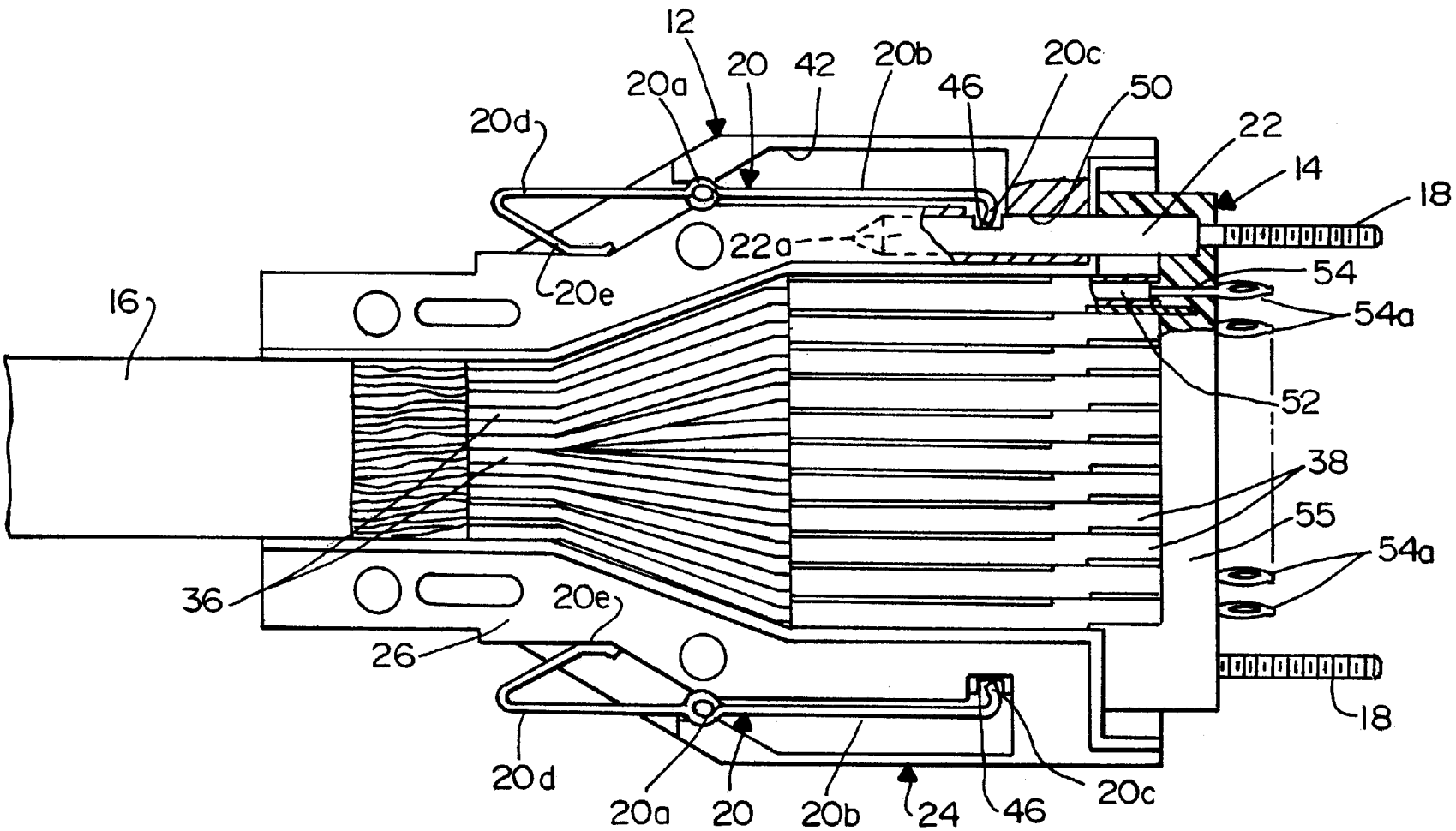
FIG. 4 is a view similar to that of FIG. 3 but showing how the second connector mates with and is latched to the connector of FIGS. 2 and 3.

As seen in FIG. 1, guide pins 22 of header connector 14 have latch portions in the form of latch notches 46 in the outside surfaces thereof. As seen in FIG. 4, housing 24 of cable connector 12 has a pair of guide holes 50 for receiving guide pins 22 of the header connector. Guide holes 50 communicate with cavities 42 of housing 24 so that latch hooks 20*c* of latch members 20 can engage within latch notches 46 in the outside surface of guide pins 22. Distal ends 22*a* of the guide pins are chamfered to provide angled surfaces for engaging latch hooks 20*c* of latch arms 20. This causes the latch hooks to be biased outwardly in the direction of arrows "B" (FIG. 3) until the latch hooks become aligned with latch notches 46 in the guide pins. When the latch hooks are in alignment with the latch notches, spring portions 20*e* of the latch arms "snap" latch hooks 20*c* into latch notches 46 to hold connectors 12 and 14 in mated condition. When it is desired to unmate the connectors, outside ends 22*b* of the latch arms are moved inwardly in the direction of arrows "A" (FIG. 3) to move the latch hooks back out of the latch notches, whereupon the connectors can be easily unmated.

Finally, FIG. 4 shows that each plastic wafer 38 is overmolded about a plurality of conductive female terminals 52 which receive a plurality of terminal pins 54 of header connector 14. The terminal pins are mounted in a housing 55 of the header connector and have terminating ends 54*a* which can be terminated to a plurality of electrical wires, other terminal devices, conductors on a printed circuit board or a wide variety of other configurations. It should be understood that the concepts of the invention, particularly the use of a dual function guide pin, are not limited to the specific cable connector 12 or header connector 14 disclosed herein.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

a first connector including a housing mounting a plurality of terminals and having a guide hole at a mating face of the housing;

a second connector including a housing mounting a plurality of terminals for connection to the terminals of the first connector when the connectors are mated, and a guide pin for insertion into the guide hole of the first connector to guide the connectors into mated condition and to latch the connectors, the guide pin including a latch portion; and a latch member on the first connector for engaging the latch portion of the guide pin when the connectors are mated to hold the connectors in mated condition, said latch member including a latch arm pivotable relative to the housing of the first connector so that the latch member engages the latch portion when disposed in an engaging first position and does not engage the latch portion when pivoted to a disengaging position;

whereby the guide pin performs a dual function of guiding the connectors as well as latching the connectors.

2. The electrical connector assembly of claim 1 wherein said latch portion of the guide pin comprises a notch in a side thereof.

3. The electrical connector assembly of claim 2 wherein said latch member includes a latch hook engageable in said notch.

4. The electrical connector assembly of claim 1, including an additional guide hole and an additional guide pin, said guide holes located at opposite ends of the mating face of the first connector, and said guide pins located on the second connector.

5. The electrical connector assembly of claim 4 wherein each of said guide pins has a latch portion, and the first connector includes an additional latch member.

6. The electrical connector assembly of claim 1 wherein said latch arm is a separate member independent of the housing of the first connector.

7. The electrical connector assembly of claim 6 wherein said latch arm is pivoted to the housing intermediate opposite ends of the latch arm.

8. The electrical connector assembly of claim 7 wherein one end of the latch arm is located inside the housing for engaging the latch portion of the guide pin, and an opposite end of the latch arm is located outside the housing for manual manipulation by an operator.

9. The electrical connector assembly of claim 8 wherein said latch arm is fabricated of spring metal material and the opposite end of the latch arm includes a spring portion for biasing the one end of the latch arm into latching condition with the latch portion of the guide pin.

10. An electrical connector assembly, comprising:

a first connector including a housing mounting a plurality of terminals and having a pair of guide holes, each of the guide holes located at one of the opposite ends of a mating face of the housing;

a second connector including a housing mounting a plurality of terminals for connection to the terminals of the first connector when the connectors are mated, and a pair of guide pins, each of the guide pins for insertion into one of the of guide holes of the first connector to guide the connectors into mated condition and to latch the connectors, each of the guide pins including a latch notch; and a pair of latch members on the first connector, each of the latch members including a latch hook engageable in one of the latch notches of the guide pins when the connectors are mated to hold the connectors in mated condition, each of the latch members including a latch arm pivotable relative to the housing of the first connector so that the latch member engages the latch notch when disposed in an engaging position and does not engage the latch portion when pivoted to a disengaging position;

whereby the guide pins perform dual functions of guiding the connectors as well as latching the connectors.

11. The electrical connector assembly of claim 10 wherein each said latch arm is a separate member independent of the housing of the first connector.

12. The electrical connector assembly of claim 11 wherein each said latch arm is pivoted to the housing intermediate opposite ends of the latch arm.

13. The electrical connector assembly of claim 12 wherein one end of each said latch arm is located inside the housing for engaging each said latch portion of the guide pin, and an opposite end of each said latch arm is located outside the housing for manual manipulation by an operator.

14. The electrical connector assembly of claim 13 wherein each said latch arm is fabricated of spring metal material and the opposite end of the latch arm includes a spring portion for biasing the one end of the latch arm into latching condition with the latch portion of the guide pin.

* * * * *